United States Patent [19]

Lyall

[11] 4,440,080

[45] Apr. 3, 1984

[54] SCREEN REGISTRATION DEVICE

[75] Inventor: Joseph G. Lyall, Lancaster, Pa.

[73] Assignee: Armstrong World Industries, Inc., Lancaster, Pa.

[21] Appl. No.: 332,750

[22] Filed: Dec. 21, 1981

[51] Int. Cl.[3] ..... B41M 1/12

[52] U.S. Cl. ..... 101/129; 33/184.5; 101/114; 101/DIG. 12; 356/399

[58] Field of Search ..... 101/115, 129, 126, DIG. 12, 101/114, 248; 356/399-401, 375; 250/561; 33/184.5

[56] References Cited

U.S. PATENT DOCUMENTS

| | | | |
|---|---|---|---|
| 2,210,474 | 8/1940 | Tillett | 101/126 |
| 3,398,633 | 8/1968 | Raivio | 356/399 |
| 3,739,177 | 6/1973 | Ko | 250/561 X |
| 3,974,766 | 8/1976 | Zimmer | 101/248 X |
| 3,998,156 | 12/1976 | Zimmer | 101/248 X |
| 4,109,158 | 8/1978 | Blitchington et al. | 356/400 X |

FOREIGN PATENT DOCUMENTS

| | | | |
|---|---|---|---|
| 2088283 | 6/1982 | United Kingdom | 101/129 |

*Primary Examiner*—Edgar S. Burr
*Assistant Examiner*—Moshe I. Cohen

[57] ABSTRACT

The invention is directed to a technique for registering the screens of a flatbed printer so that a series of screens will be able to print different colors of ink in registration in a sequential printing operation. A device with lights in a set pattern will be used to register a series of screens. The lighted pattern on the registration device will be used in conjunction with registration openings or other markings in the screens to provide proper screen registration so that accurate printing registration will exist from the very beginning of printing of a design on a carpet or light fabric structure.

3 Claims, 4 Drawing Figures

SCREEN REGISTRATION DEVICE

BACKGROUND OF THE INVENTION

The invention is directed to a screen registration device and, more particularly, to a device that will register the screens of a flatbed screen printer without the need of printing a series of patterns with ink through the screens to adjust the pattern registration between the screens.

DESCRIPTION OF THE PRIOR ART

U.S. Pat. Nos. 3,974,766 and 3,998,156 disclose registration systems for the screens of a Zimmer printer. However, these registration systems involve sensors in electrical systems.

The use of light devices to register a pattern in a printing surface is known in the art. In U.S. Pat. No. 3,398,633 there is disclosed an apparatus for securing the desired registration between a pattern and a printing surface. The device of the patent includes a model surface and a printing surface. Relatively movable supports are provided for the above plus an enlarging optical system for viewing superimposed images of the corresponding regions of the two surfaces. The two supports in the optical system are relatively movable in the printing direction so that the two surfaces may be conjointly explored.

SUMMARY OF THE INVENTION

The invention is directed to the device which permits the practice of the inventive method herein.

The device is used in combination with the screens of a flatbed printer and the combination performs the claimed method.

The device is basically composed of a bar containing lights arranged in a pattern.

The device is used in conjunction with the screens of a flatbed screen printer and the pattern of the lights on the device are arranged in conformity with the registration pattern provided on the screens of the flatbed printer.

The device is initially placed on the carpet structure and the carpet structure is normally the reusable leader portion just prior to a roll of carpet that is to be printed. The carpet is moved by normal machine movement to place the device under the screen. One observes the light pattern of the device through the registration openings in the screen and the screen is adjusted to center the light patterns of the device in the registration opening of the screen. The carpet is then moved again by the normal machine movement which means the carpet and the device thereon is moved from one screen to a second screen position. Registration of the second screen is then carried out relative to the light pattern of the device. Such continual registration is carried out until all screens are in register with the light pattern of the device. The device is removed from the carpet and the beginning portion of the carpet to be printed is placed under the first screen. All the screens are now in registration and the printer will print a pattern on the carpet with the different components of the pattern, as set forth in the different screens, being placed in registration on the carpet.

DESCRIPTION OF THE PREFERRED EMBODIMENT

Figure 1:
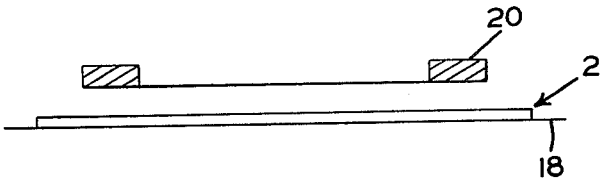
FIG. 1 is a sideview of the inventive device herein in position on a carpet under a screen.

The invention herein is designed for use with the conventional Zimmer flatbed screen printer which is produced by the Peter Zimmer Company of Austria. This particular printer is composed primarily of a flat table upon which a fabric, preferably a carpet, sits. The conveying means move the carpet in an intermediate step operation under a series of flat screens. The composite of the patterns in each of the screens, when placed in registry, forms a decorative design on the carpet. Each of the screens must be in registration with the other screens so that the individual patterns of the overall design will be in register. The path of movement for the carpet structure is equal to one-half the distance between the center line of the screens so that if the screens are in register the carpet will be able to move from one screen to another and have the patterns placed thereon on every other advance so that the end product will have all components of the pattern in register. The screens are movable from a raised position to a lower position in contact with the carpet. During the time that the carpet moves from one position to another, the screen is held in a raised position. Once the carpet has stopped moving, the screen moves down against the carpet and ink applied to the top of the screen is forced through the pattern holes of the screen by appropriate conventional rollers to push ink into the carpet being printed. The invention is not restricted to carpet but it could be utilized when the flatbed screen printer is being used to print any type of surface which may be conventionally printed by a screen printer. The invention is directed to a device which will be used in combination with conventional screens to carry out a method of registering the screens.

The Zimmer machine is provided with adjustment means on both ends of the screen to adjust the position of the screen. The corners of the screen are resting upon pillar blocks which support the weight of the screen and move the screen between its lowered and raised position. In addition, adjusting screws are provided on one side of the screen to permit it to be adjusted back and forth along the machine direction, that is, the direction the carpet moves. On the other side of the screen there is an adjustment to permit the screen to be adjusted also along the machine direction and further in a direction across the machine direction. Consequently, both sides of the screen may be adjusted to position the screen so that it is exactly perpendicular to the line of movement of the carpet and in addition the screen is adjustable along the axis of carpet movement and an axis which is exactly perpendicular to the line of movement of the carpet. With these adjustments the screen may be moved along the direction of movement of the carpet and back and forth across the direction of the carpet until the pattern of the screen is positioned in registration with appropriate registration marks or previous patterns printed on the carpet.

Figure 4:
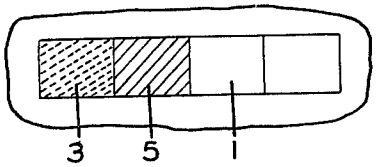
FIG. 4 is a top view of the registration pattern printed.

In normal use the carpet to be printed would be placed under the first screen and a pattern would be printed by the first screen once the first screen was adjusted perpendicular to the axis of movement of the carpet through the use of appropriate mechanical squares. The carpet would then be moved to the second screen. When the first pattern was printed by the first screen onto the carpet, not only was the pattern printed in the center region of the screen but along both edges of the carpet there was printed a block called a registration block, and it is in the form of an elongated plural open block arrangement. When the carpet is fully printed, there will be a series of registration blocks on the carpet, one after the other extending parallel to the axis of movement of the carpet. When the carpet moves to the second screen, one open block of the first registration block has to be viewed through a registration opening in the second screen. The second screen is adjusted until the one open block of the first registration block appears in the proper position in the opening in the second screen. When the design is printed through the second screen a solid registration block is printed in an open block of the first registration block arrangement. The printing of the third screen will print another solid registration block in the next open block of the plural block arrangement. In FIG. 4, the registration pattern is shown. Element 1 is the open block arrangement that is printed first at the first screen. Element 3 is the second screen solid registration block. Element 5 is the third screen solid registration block. It can be seen that the registration of the carpet is actually being carried out while the carpet is being printed as it passes through the printer. No matter how careful one may be, one may not secure a perfect registration when the carpet passes through the first series of screens and, when the carpet finally emerges from beneath the last screen, it is possible that defects in the registration can be noted which were missed during the registration stage. Appropriate adjustments have to be made in the screen and all of this work is being done on good carpet material which is now unsaleable carpet material due to misregistration errors existing thereon. Consequently, it would be preferable that the screens be placed in proper registration prior to the time that they are actually printing the good carpet material in order to avoid spoilage of good carpet material.

Figure 2:
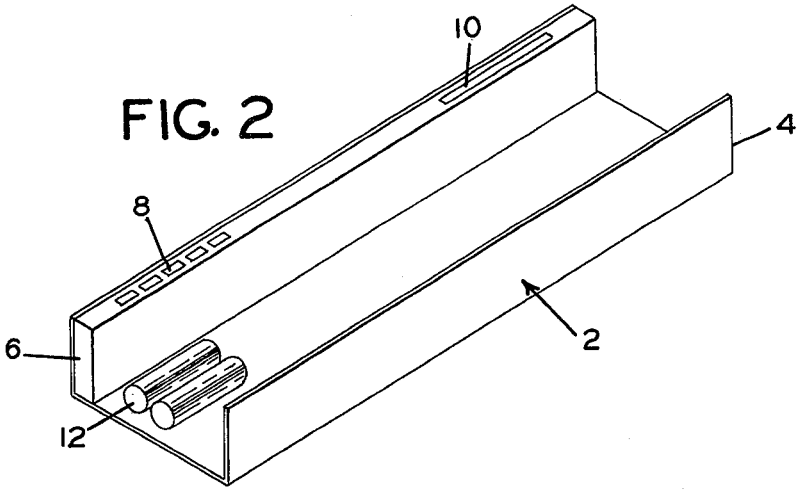
FIG. 2 is a perspective view of the device herein.
Figure 3:
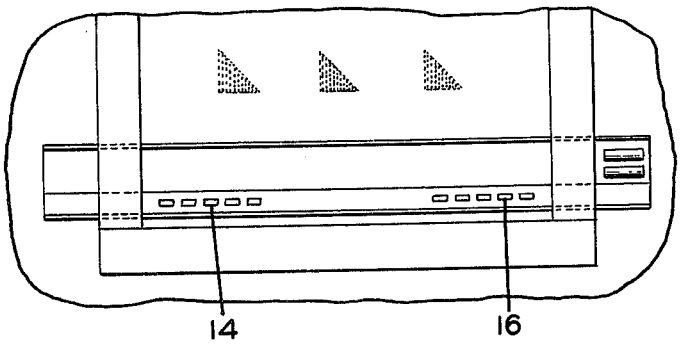
FIG. 3 is a top view of the end of a screen structure showing the inventive device in position for registration purposes.

The inventive device herein is meant to carry out the registration of the screens of a flatbed screen printer without an actual printing of a design and registration marks on a carpet structure. The inventive device herein is shown in FIG. 2. The device 2 is composed of a channel or similar flat structure 4 which has the opening of the channel structure facing upward. Along one edge of the channel structure there is provided a light box 6 which has on its upper surface at least two arrays of light 8 and 10 set forth in some type of pattern arrangement. An appropriate battery 12 provides power to illuminate the lights in the two pattern arrays 8 and 10. The two arrays 8 and 10 can be composed of a series of individual lights shining through individual lenses or could be a single light shining through a series of lenses. Normally array 8 would be a series of small rectangular blocks of light which would be the same size as the registration openings on the screen of the flatbed screen printer. Registration array 10 is nothing more than the individual rectangular light patterns of array 8 being formed as a single bar of light 10. Since the screen of the conventional flatbed screen printer has thereon the registration openings and normally has at least two patterns of registration openings on each side of the screen as shown in FIG. 3, the distance between light arrays 8 and 10 are exactly the same as the distance in patterned openings 14 and 16 shown in FIG. 3. The registration device 2 is placed on a carpet or some other structure 18 which is moving on the bed of a conventional Zimmer printer. The device is moved under a screen 20 and in the form shown will function with the screen in its raised position. Consequently, with the device of FIG. 2, there is no need to raise and lower the screen during the registration process. It is possible that the device 2 of FIG. 2 could be made with an enlarged end containing a battery pack and this end would be outside of the area covered by the screen. The portion of the device which then goes under the screen would be made very thin and fiber optics could be used to feed light to the different light arrays 8 and 10. Consequently, that type of device could be used with the screen in its lowered position.

The device 2 must be placed on the material being conveyed by the printer. The device 2 is positioned by the use of mechanical squares so that it has its axis, and particularly the axis through the light arrays, extending parallel with the axis of movement of the carpet structure. As now designed, the registration device has a groove machined on one end which can be registered to a wire stretched across the machine to assure that the first print screen is placed on the printer square to the center line of the carpet travel. It is possible that two separate registration devices could be used, one on each side of the carpet. Or one could use a single registration device and line up one side of the screen and then repeat the process to line up the opposite side of the screen since both sides of the screen are provided with registration openings 14 and 16. It is advisable to register both sides of the screen in order to provide accurate registration between the series of screens. Once the device 2 is in position the machine is cycled through one intermittent movement cycle so that the device is moved under a screen 20. One then observes the light arrays 8 and 10 through the openings 14 and 16 that exist on the screen 20. The light arrays 8 and 10 must be in alignment with the openings 14 and 16. The individual, separate small rectangular blocks of array 8 would be lined up with the individual blocks of the openings 16. The light bar 10 would be lined up with the opening 14. It is possible that each of the individual blocks of array 8 could be composed of different color lights, each of the different colors would be viewed through the individual holes of openings 16. The screen is adjusted through its conventional adjusting structures to bring the two light arrays 8 and 10 into alignment with the openings 14 and 16. The carpet is then cycled through another two movement cycles and the device 2 then moves under the next screen wherein the openings therein have to be aligned with the light arrays 8 and 10. The sequence is followed until all the screens are in register with the light arrays 8 and 10 as they sequentially move through the printer. As was indicated above, two registration devices 2 could be used, one on each side of the screen or first one side of the screen could be aligned and then the second side of the screen aligned. Also it is possible that registration could be carried out by only using one light array 8 and one series of openings 16.

The advantage of the device herein is that when one desires to print a pattern on a carpet, the carpet is not printed to carry out registration. Normally a long and unserviceable piece of carpet structure is fed through the printer, steamer, and washer to function as a leader to pull the serviceable carpet through the assembly of treating apparatuses. Before the serviceable carpet starts moving through the screen printer and while the leader is moving through the screen structure of the printer, it is possible to place the device 2 on the leader and register the different screens so that when the first part of the serviceable carpet moves under the first screen, printing can start on the leading edge of the serviceable carpet and this first printing will be in total registration with all the screens printing in registration as the carpet passes through the printer. Consequently, there is no waste of the good carpet material since registration is actually carried out well before printing and need not be carried out on the good carpet material as was previously conventional in the art.

What is claimed is:

1. In a flatbed screen printer having a plurality of flat printing screens thereon, each said screen having a pattern of openings on the edge thereof, the improvement comprising:

(a) a registration device comprising
  (1) a body member which is channel-shaped having a base and two upright sides with an open top,
  (2) positioned within said open top and adjacent one side there is a light box containing a plurality of lights positioned therein in at least one light pattern array, and
  (3) a power supply for illuminating said light, (b) said screen having an array of light viewing openings therein with a pattern similar to the pattern of the lights on the registration device, (c) means for adjusting the position of the screen to secure registration of the accumulation of individual pattern openings of the screen to all or part of the pattern of light on the registration device, and (d) means for moving said registration device to the next screen in sequence, whereby registration of the accumulation of individual pattern openings in the second screen can be made with all or part of the patterns of lights on the registration device.

2. A method of carrying out registration of a series of printing screens in a conventional flatbed printer which has a means of conveying material to be printed through the printer underneath the series of screens, there being a number of screens positioned sequentially on the printer, all positioned a set distance apart which is equal to the length of the path of movement of the material to be printed as it moves sequentially through the printer, the method comprising the steps of:

(a) placing a registration device on the printer so that it may be moved sequentially under the series of screens, the registration device having a patterned array of lights, (b) securing a proper positioning of the registration device on the printer so that the registration device is moving in a path parallel with the axis of movement of the material being moved on the printer, (c) moving said device through the normal sequential path of movement of the screen printer to place the registration device under a printing screen, (d) observing the light pattern on the registration device through a pattern of openings on the screen, (e) adjusting the screen to center the pattern of light on the registration device in the pattern of openings on the screen to secure a registration of the pattern of lights and the pattern of openings, (f) then sequentially moving the registration device to the next screen and then adjusting the second screen to secure registration of its pattern of openings to the pattern of lights on the registration device, and (g) continuing such movement of the registration device until it is placed in registration with all the screens of the printer.

3. A method of carrying out registration as set forth in claim 2 wherein two registration devices are utilized with a registration device being positioned adjacent each side of each of the screens, whereby both sides of the screen may be registered relative two separate registration devices.

* * * * *